US009612036B2

(12) United States Patent
Hannibalsen

(10) Patent No.: US 9,612,036 B2
(45) Date of Patent: Apr. 4, 2017

(54) HOUSING UNIT FOR A HEATING SYSTEM

(75) Inventor: Lars Hannibalsen, Bjerringbro (DK)

(73) Assignee: Grundfos Management a/s, Bjerringbro (DK)

( * ) Notice: Subject to any disclaimer, the term of this patent is extended or adjusted under 35 U.S.C. 154(b) by 1009 days.

(21) Appl. No.: 13/161,545

(22) Filed: Jun. 16, 2011

(65) Prior Publication Data

US 2011/0308767 A1 Dec. 22, 2011

(30) Foreign Application Priority Data

Jun. 19, 2010 (EP) ..... 10006395

(51) Int. Cl.
*F24H 9/14* (2006.01)
*F24D 3/08* (2006.01)
*F24D 19/10* (2006.01)

(52) U.S. Cl.
CPC ..... *F24H 9/142* (2013.01); *F24D 3/08* (2013.01); *F24D 19/1033* (2013.01); *F24H 9/144* (2013.01)

(58) Field of Classification Search
CPC . F24H 9/14; F24H 9/142; F24H 9/144; F24H 9/146; F24H 1/52; F24D 3/105; F24D 3/1066; F24D 3/08; F24D 19/1033; F24D 19/1024
USPC ..... 237/19
See application file for complete search history.

(56) References Cited

U.S. PATENT DOCUMENTS 3,582,229 A * 6/1971 von Fellenberg ..... 415/47
3,934,609 A * 1/1976 Haggqvist ..... 137/565.26
4,460,328 A * 7/1984 Niederholtmeyer ..... 588/320
4,743,481 A * 5/1988 Quinlan et al. ..... 428/35.7
5,165,596 A * 11/1992 Le Mer ..... 237/8 R
2009/0095235 A1* 4/2009 Alessandrini ..... 122/20 R

FOREIGN PATENT DOCUMENTS

DK DE 4018929 C1 * 10/1991 ..... F24D 3/08
DK DE 19912284 A1 * 9/2000 ..... F24H 9/122
(Continued)

OTHER PUBLICATIONS

Machine translation of EP0918197 from Google Patents.*
(Continued)

*Primary Examiner* — Avinash Savani
*Assistant Examiner* — Deepak Deean
(74) *Attorney, Agent, or Firm* — Panitch Schwarze Belisario & Nadel LLP

(57) ABSTRACT

A housing unit (22) for a heating device with two heating circuits, one for space heating and another for service water heating, includes a pump housing (23) for a recirculation pump (8). The housing unit (22) encompasses a switching valve for switching the heating circuits, and in its rear installation position exhibits at least one port to directly connect a plate heat exchanger (6) for heating service water. An opening (29) for the return of the space heater is arranged on one side of the housing unit. The housing unit incorporates an inlet chamber (28), which is adjoined by the inlet mouth (26) of the pump (8), and into which two channels empty, of which one or the other can be optionally closed by a valve body (32), and of which one channel leads to the line port (30) for the return, and the other channel leads to a port of the plate heat exchanger (6).

13 Claims, 9 Drawing Sheets

(56) References Cited

FOREIGN PATENT DOCUMENTS

| | | | | | |
|---|---|---|---|---|---|
| DK | EP 1418387 | A1 * | 5/2004 | ..... | F24D 3/08 |
| DK | EP 1528329 | A1 * | 5/2005 | ..... | F24D 19/083 |
| DK | EP 1884717 | A1 * | 2/2008 | ..... | F24D 3/08 |
| DK | EP 1884720 | A1 * | 2/2008 | ..... | F24H 1/52 |
| DK | EP 2093515 | A1 * | 8/2009 | ..... | F24H 9/14 |
| DK | EP 2093517 | A1 * | 8/2009 | ..... | F24H 9/14 |
| EP | 0874201 | A2 | 10/1998 | | |
| EP | 0918197 | A2 | 5/1999 | | |
| EP | 1528330 | A1 | 5/2005 | | |
| EP | 2148149 | A2 | 1/2010 | | |
| IT | EP 1582824 | A2 * | 10/2005 | ..... | F24D 19/1066 |
| IT | EP 1650506 | A1 * | 4/2006 | ..... | F24H 9/14 |

OTHER PUBLICATIONS

Machine translation of EP1528330 from Google Patents.*
European Search Report Issued Sep. 2, 2010 in European Application No. 10006395.7; Written Opinion.

* cited by examiner 35
38
34
33
36
32
22
37
29
30
23
43
39
42
40
50
24
25
19

HOUSING UNIT FOR A HEATING SYSTEM

BACKGROUND OF THE INVENTION

The present invention relates generally to a housing unit for a heating device.

In order to improve and simplify the design of heating systems, in particular heating devices provided for wall installation, i.e., compact heating systems, such as gas heaters, the prior art typically provides housing units including of one or more injection molded plastic parts. The prior art also provides that the necessary electrical, electronic, hydraulic and mechanical components be integrated therein. The housing units for pure space heating systems here essentially differ structurally from those for heating systems with two heating circuits, in which one is provided for space heating, and another for service water heating. In addition to the always present, at least one recirculation pump, the latter exhibit a heat exchanger, typically a plate heat exchanger, as well as a switching valve or another recirculation pump. In models operating with a switching valve, there are in turn two variants, which specifically have the switching valve in the flow or the switching valve in the return.

For example, a housing unit of the latter type is known from EP 0 918 197 B1. A switching valve is there arranged in the inlet chamber of the pump, wherein the valve body closes or opens the return line of the space heater or return line from the plate heat exchanger, depending on the switch position. The valve body sits on a lever, which is situated roughly vertically in the installed position, and whose other end downwardly exits the housing in a sealing manner, wherein the latter is actuated by means of an electric positioning motor, which is secured to the outside of the housing.

The disadvantage to the housing assembly described in EP 0 918 197 B1 is that the two line ends closed or opened by the valve body are formed by separate injection molded parts, which must only be integrated into the actual housing after its manufacture, which results in added assembly outlay and, given the additional components, added tooling outlay as well. Another disadvantage is that arranging the electric motor on the bottom side of the housing unit impedes the natural line progression, in particular because the return line for the space heater must be rerouted. Therefore, the disadvantage to the housing unit described therein is that it has relatively complex line guides on the inlet side, and the plate heat exchanger can only be laterally shifted and arranged behind the latter, which presents an obstacle to a compact design. The channels running to the plate heat exchanger inside the assembly also require a complicated adapter component to be separately fabricated, which further increases the tooling outlay.

BRIEF SUMMARY OF THE INVENTION

Against the backdrop, an objective of a preferred embodiment of the present invention is to create a housing unit for a heating device for a heating system with two heating circuits and a switching valve arranged on the inlet side of the pump, meaning a switching valve in the return lines, which are easy to assemble, inexpensive to manufacture and versatile in use.

The above objective is achieved according to a preferred embodiment of the present invention by a housing unit of a heating device for a heating system with two heating circuits, one for space heating and the other for service water heating, including a pump housing for a recirculation pump, and encompassing a valve situated on the inlet side of the pump for switching the heating circuits. In its rear installation position, the housing unit exhibits at least one port to directly connect a plate heat exchanger for heating service water. In addition, one side of the housing unit exhibits an opening for the return line of the space heater. The inlet chamber formed within the housing unit is adjoined with the inlet mouth of the pump, and exhibits two channels that empty into the latter, of which one or the other can optionally be closed by a valve body of the valve, and of which one channel leads to the line port for the return line of the space heater, while the other channel leads to a port for the return line of the plate heat exchanger.

The housing unit according to a preferred embodiment of the present invention can advantageously be connected by at least one port directly to a plate heat exchanger hooked up in the rear installation position. Since the plate heat exchanger is a comparatively massive metal component in practice, the latter represents not just a hydraulic, but also a mechanical port, which also mechanically fixes the housing unit inside the heating device. Depending on the type and given a suitable channel arrangement and configuration, it is possible to forego the pipe sections to be integrated into the inlet chamber within the housing unit, and the housing unit can also be manufactured without lost cores. The structural design of the housing unit enables a tool having only drawing and/or swivel cores, or comparable reversible cores, which is known to be especially favorable for serial production.

A preferred embodiment of the housing unit advantageously exhibits two ports situated one over the other in the rear installation position, which are arranged and configured in such a way making them suitable and intended for direct connection to one of the two port pairs of the plate heat exchangers. This completely eliminates the need for a rear piping of the housing unit, as the two ports immediately adjoining the plate heat exchanger ensure not just a compact structural design, but also a good mechanical fit of the components involved.

While the one channel that empties into the inlet chamber of the pump leads to the line port for the return line of the space heater, a further development of a preferred embodiment of the present invention provides that the other channel be routed to the lower port of the port pair of the plate heat exchanger. The housing unit according to a preferred embodiment of the present invention can be used in a variety of ways, since it can be optionally connected to the right or left port pair of the plate heat exchanger. Therefore, heating devices of varying type can be furnished with a housing unit.

It is especially advantageous in a further development of a preferred embodiment of the present invention for the bottom side of the housing unit to be provided with an opening for the return line of the space heater. This opening, which is advantageously larger than a conventional line port, can be used to remove the core from a portion of the housing unit interior, wherein a corresponding port is provided there for the subsequent connection of the return line, for example, integrated there by way of a corresponding metal section or plastic section. In addition, it is especially advantageous to let the return line empty into the housing unit from below, since it is then guided in a quasi-direct manner through the heating device. The four water-carrying connecting lines typically enter from below in such heating devices, in particular wall-mounted heating devices.

The channels formed in the inlet chamber in the housing unit are advantageously formed by pipe sections projecting into the latter, which are arranged and oriented in such a way as to end there in an aligned manner, spaced apart from each other. A valve body situated at the end of a lever arm can then be arranged between these ends in a known manner, and optionally used to close or open one or the other channel.

It is especially advantageous for the valve body to be arranged at the end of a lever, which in the installation position is essentially horizontally situated, and tightly guided outwardly through a housing wall on the side, preferably on the left side, while its other end is coupled with a positioning motor that can there be secured to the housing unit from outside. Such a laterally secured positioning motor is readily accessible, and can hence be changed out in a few manual steps during operation, meaning in the installation position.

In order to separate out the gases included in the primary circulation, which as a rule are introduced via the heating circuit of the space heater but also in some other way, it is advantageous for the housing unit to be designed in such a way that an air separation housing including part of the housing unit adjoins the inlet chamber. Hence, such an air separation housing can typically be designed as a single piece with the assembly, and is situated in the area preceding the inlet mouth, meaning where the flow is calmest, making gas separation the most effective.

Heating devices of the kind in question typically exhibit a bypass closed by a pressure-relief valve between the heating flow and heating return, so as to ensure that the circulation function inside the heating device is guaranteed even when all thermostat valves are closed during space heating, and hence the dissipation of heat from the primary heat exchanger. In an advantageous further development of a preferred embodiment of the present invention, the housing unit is designed in such a way that the bypass empties in the inlet chamber of the pump, wherein the pressure-relief valve is integrated into the housing unit on the inlet chamber side. While these features do represent an advantageous further development of the previously described housing unit, they can also be advantageously used independently of the features described above. Because the pressure-relief valve is integrated into the housing unit on the inlet chamber side, a suitable configuration of the housing unit largely eliminates the need for piping for the bypass, wherein a corresponding line port for the bypass on the housing unit is sufficient.

In order to also eliminate the need for the otherwise usual bypass line within the heating device, a further development of a preferred embodiment of the present invention provides that the bypass runs along at least a portion of the line supplying the plate heat exchanger with heat, wherein in particular the channel of the housing unit adjoining the plate heat exchanger on the back also forms part of the bypass. This structurally especially advantageous configuration, in which a separate bypass line can in the final analysis be almost completely omitted, is based on the consideration that the line leading through the plate heat exchanger forms a parallel line to the lines of the heating device leading to the radiators for space heating anyway, which can also serve as a bypass line given the proper wiring.

In a further development of a preferred embodiment of the present invention, the housing unit according to a preferred embodiment of the present invention here exhibits a channel that leads from the plate heat exchanger to the valve for switching the heating circuits, which has a branching for the bypass that is closed during normal operation by the pressure-relief valve and ends in the inlet chamber. This branching is necessary for securing the bypass function even when the return line of the heat exchanger is closed by the valve.

In the housing unit according to a preferred embodiment of the present invention, the bypass is advantageously formed by a bypass channel that preferably opens to the outside at the top in the housing unit, which intersects the channel leading from the heat exchanger to the valve for switching the heating circuits, and is connected by a line with the inlet chamber through a recess in the wall. This configuration is structurally especially favorable, since such outwardly opening channels can be generated in terms of tools without lost cores in the case of injection molded plastic parts. In addition, the arrangement has the advantage of shorter lines. As a result, the bypass is realized in a quasi-shortest way, while the housing unit simultaneously serves to receive the pressure-relief valve, which closes the bypass under normal pressure conditions.

The pressure-relief valve arranged in the bypass is advantageously incorporated into the bypass channel from outside like a cartridge, and there detachably secured. In this way, the pressure-relief valve can be monitored for maintenance purposes, and quickly replaced as needed, without lines or line ports having to be disassembled.

As already explained above, it is especially advantageous for the return line of the plate heat exchanger to be formed by the lower port, which is connected via the other channel with the inlet chamber or valve situated there inside the housing unit. In this case, the upper port of this port pair can be formed by a line channel preferably bent by about 90° and preferably directed toward the left in the installation position, which is part of the housing unit, but situated outside of the housing unit relative to the inlet chamber. Such a line channel can be conveniently realized in terms of tooling, and also puts the upper line port of the plate heat exchanger in a readily accessible area of the heating device, where the line connection with the service water line can be established.

The housing unit is preferably formed by a one-piece injection molded plastic component, which is fabricated without lost cores. It goes without saying that this concept of a single piece in terms of a preferred embodiment of the present invention is not countered by the cover disk which is to be integrated between pump impeller and inlet chamber forming the subsequent inlet mouth of the pump, as well as the line port for the return line of the space heater which is integrated into the lower opening of the housing unit, as separate components made out of plastic and/or metal.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
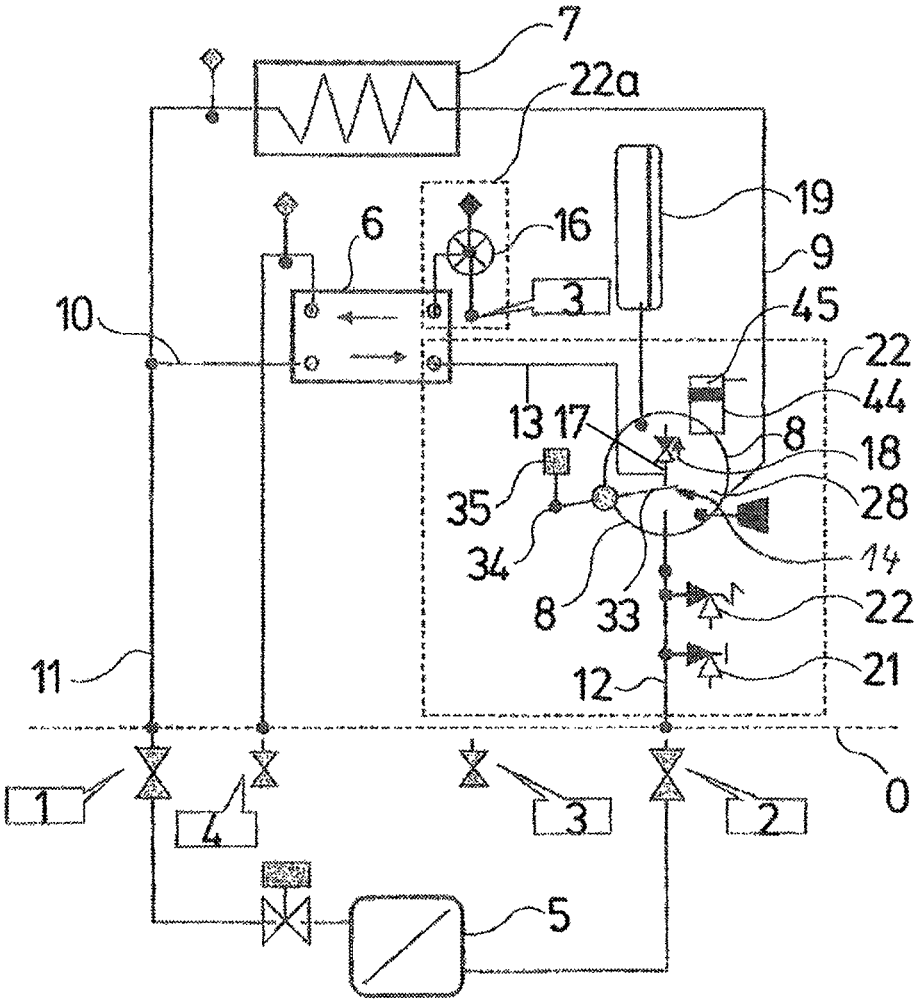
FIG. 1 is a highly simplified schematic view of a hydraulic diagram of a heating system in accordance with a preferred embodiment of the present invention.
Figure 2:
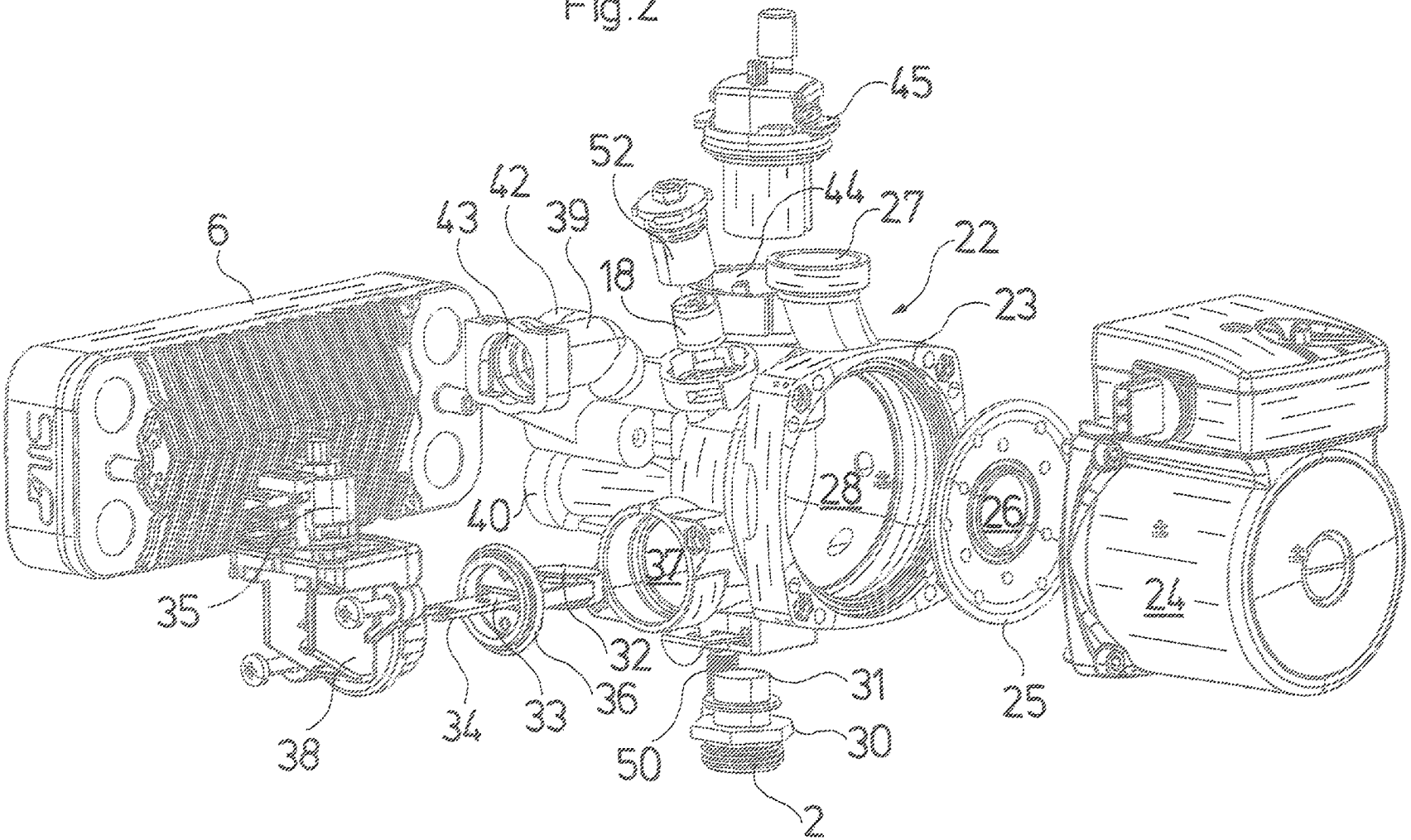
FIG. 2 is a simplified, perspective, exposed view of a housing unit according to a preferred embodiment of the present invention with add-ons and built-ins as seen from the left and front in the installation position.
Figure 3:
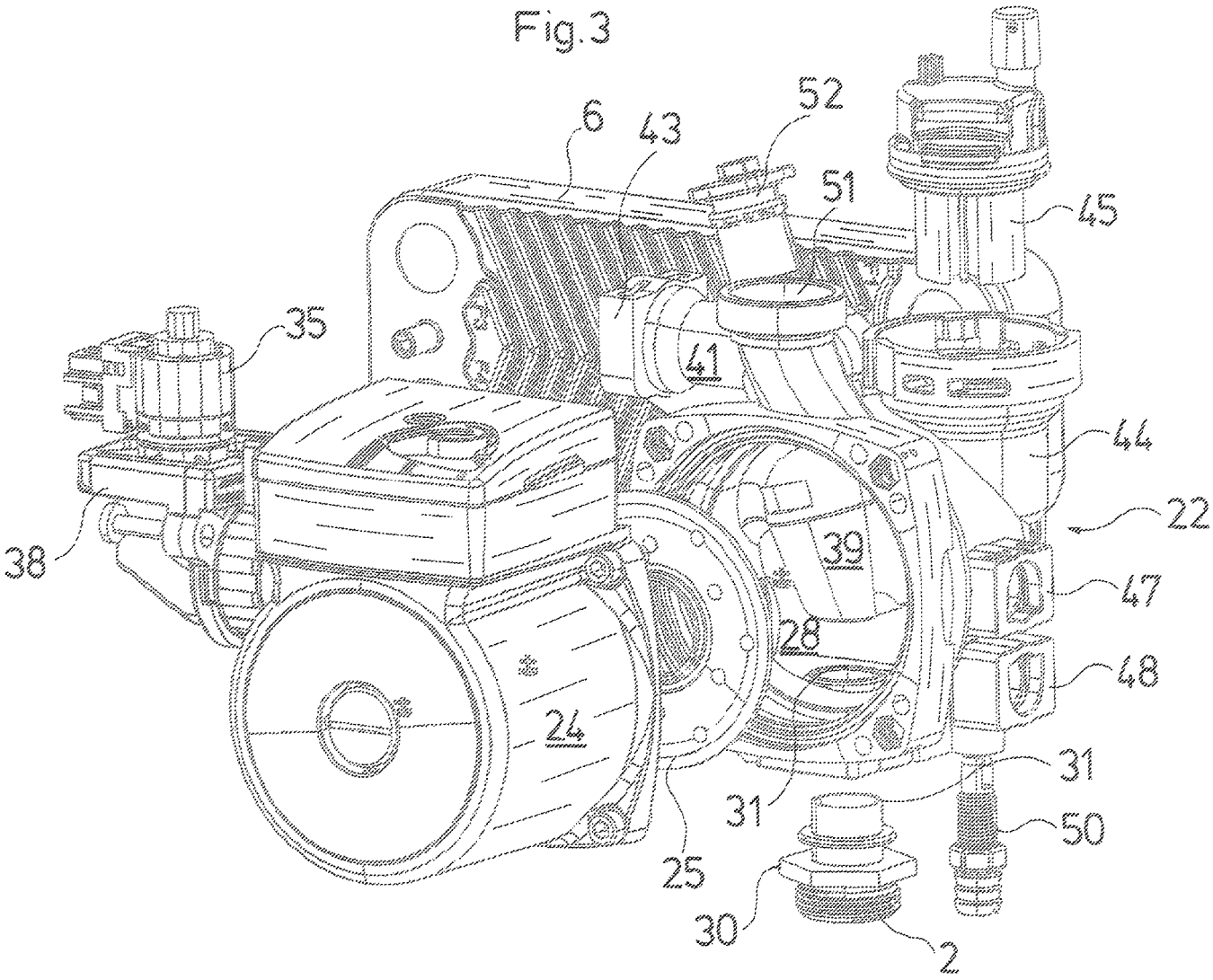
FIG. 3 is a perspective, exploded view according to FIG. 2, but as seen at an inclination from the right and front in the installation position.
Figure 4:
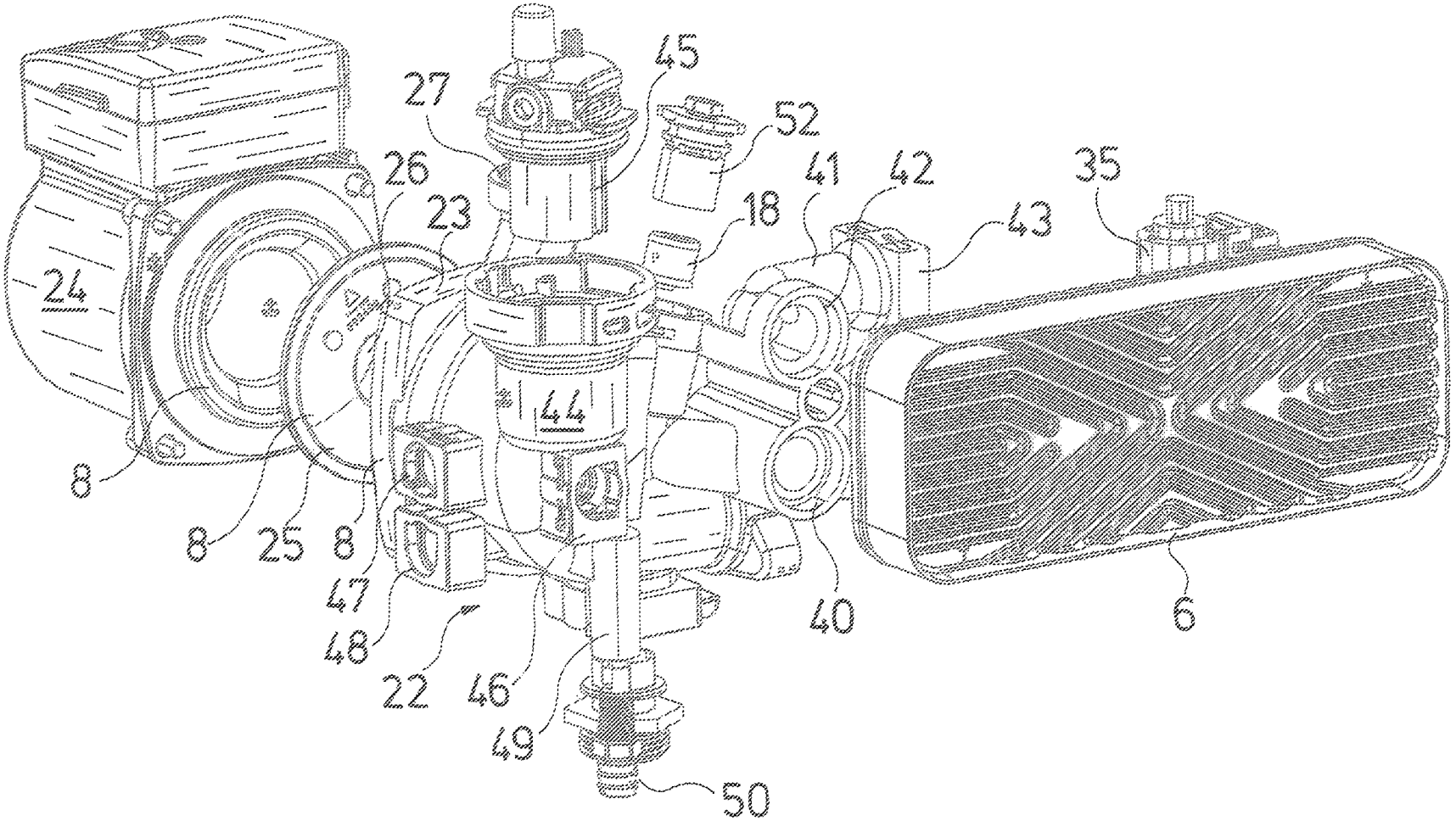
FIG. 4 is a perspective, exploded view according to FIG. 2, but as seen at an inclination from the right and back in the installation position.
Figure 5:
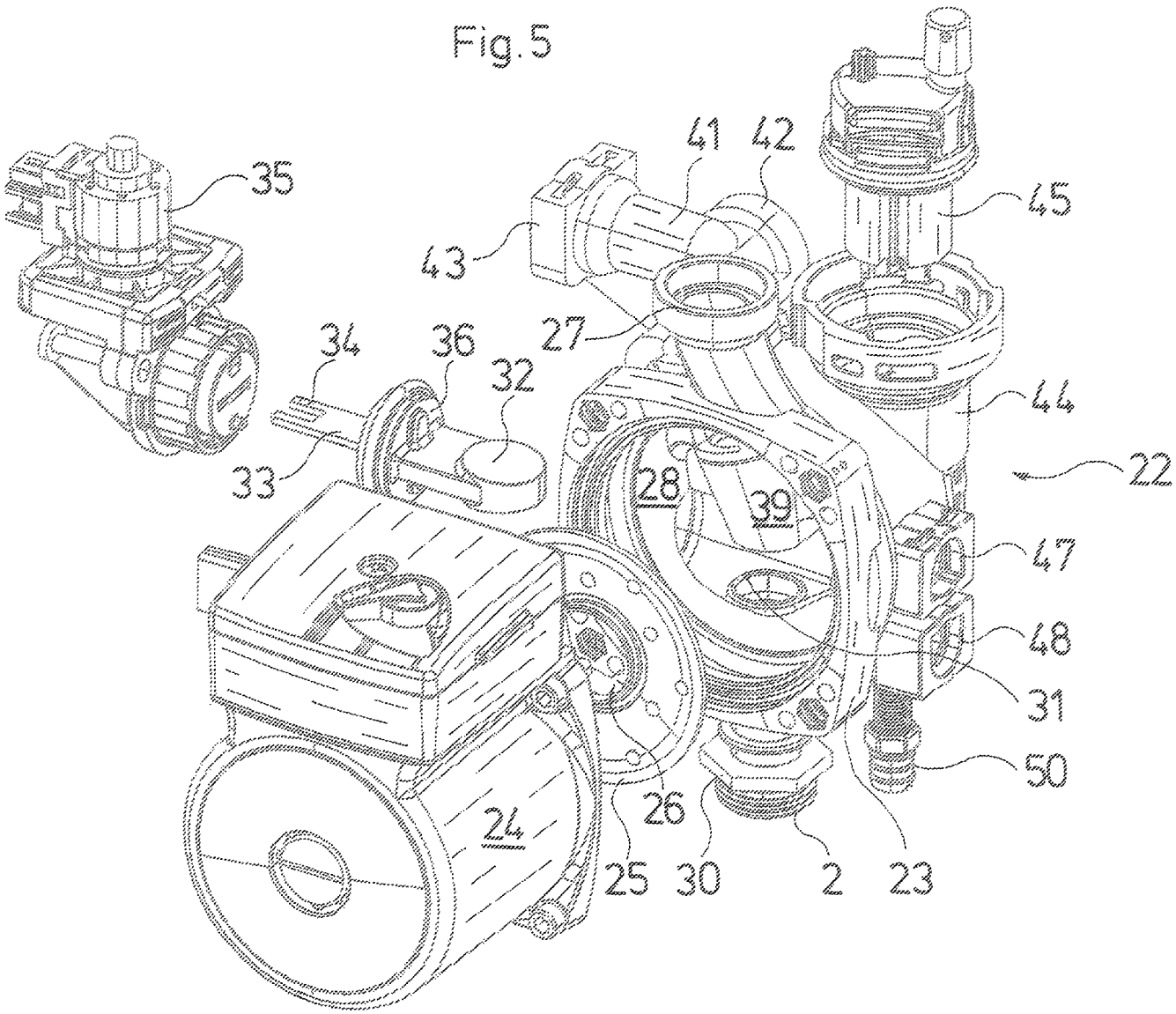
FIG. 5 is a perspective, exploded view of the housing unit without heat exchanger as seen from the front, right and above.
Figure 6:
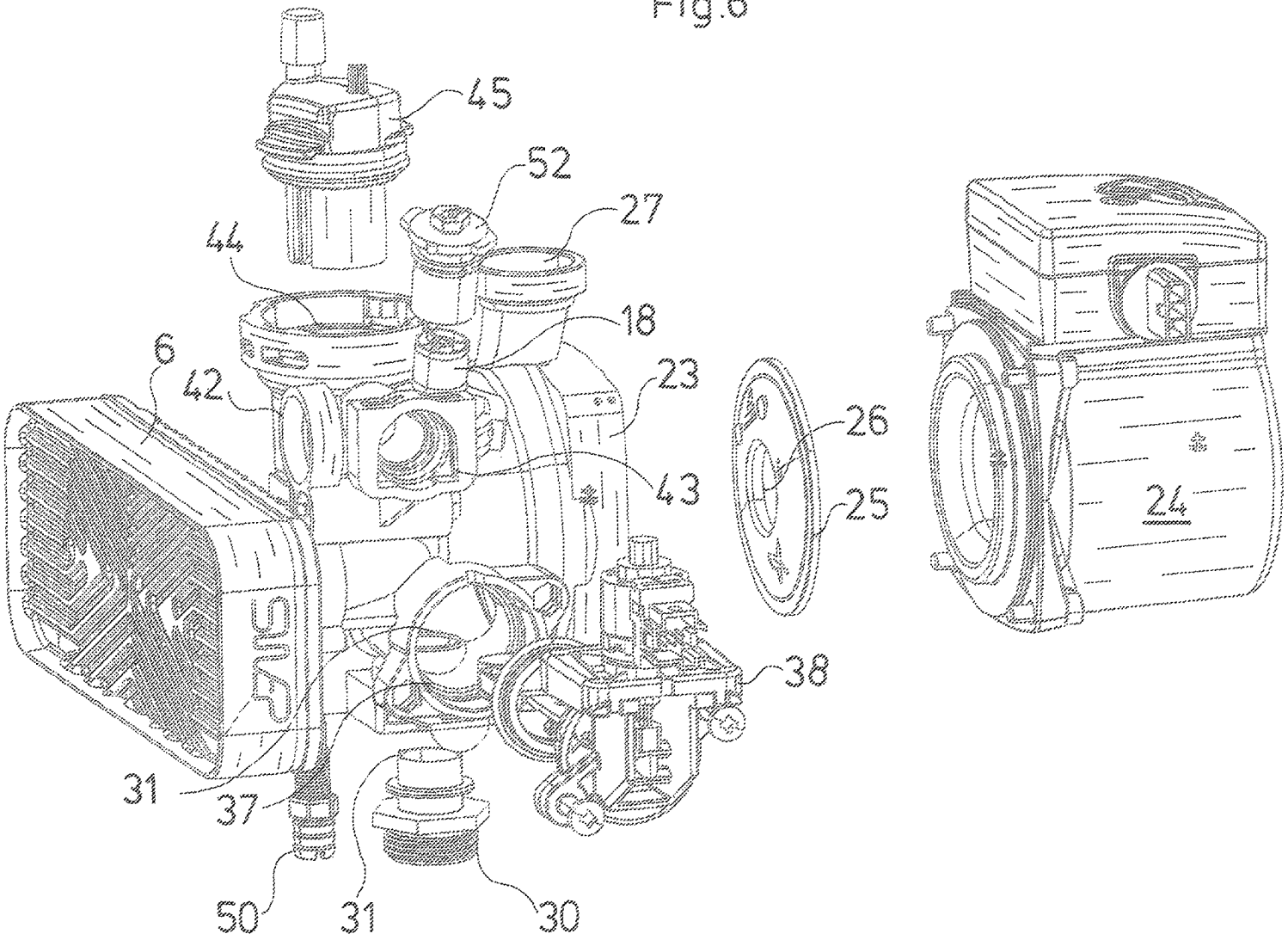
FIG. 6 is a perspective, exploded view according to FIG. 5, as seen at an inclination from the left and back.
Figure 7:
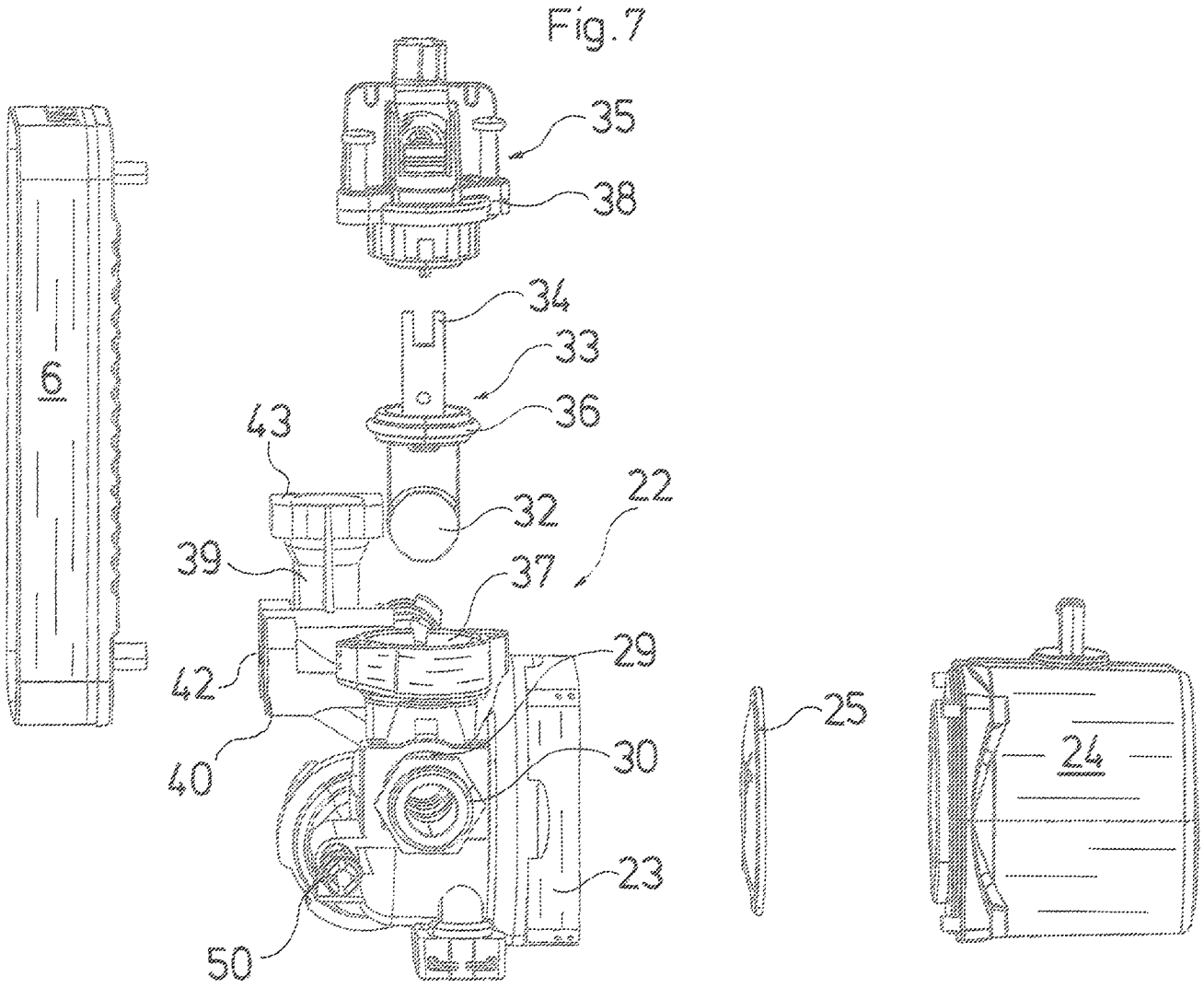
FIG. 7 is an exploded view according to FIG. 2, viewed from above.
Figure 8:
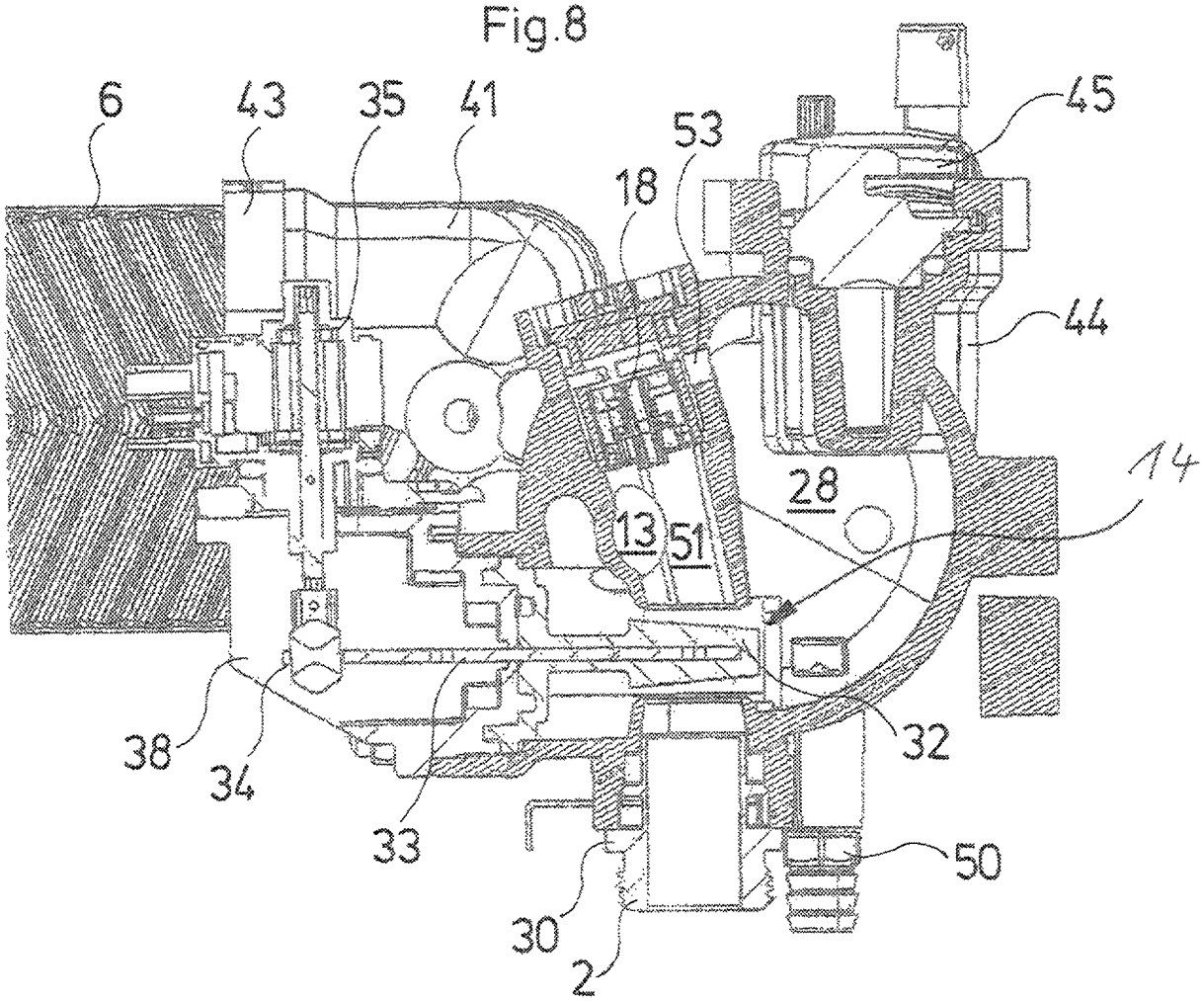
FIG. 8 is a section through the housing unit in a plane roughly parallel to the plate heat exchanger.

Certain terminology is used in the following description for convenience only and is not limiting. The words "right," "left," "lower," "bottom," "upper," "top," "front" and "rear" designate directions in the drawings to which reference is made. The word "outwardly" refers to a direction away from the geometric center of the device, and designated parts thereof, in accordance with the present invention. Unless specifically set forth herein, the terms "a," "an" and "the" are not limited to one element, but instead should be read as meaning "at least one." The terminology includes the words noted above, derivatives thereof and words of similar import.

The heating system depicted based on FIG. 1 preferably exhibits two heating circuits, one for space heating, and another for service water heating. The system preferably includes the actual heating device, which can be designed as a wall-mounted gas heating device, or floor-mounted heating device. The device-side portion preferably includes of the part of the heating system represented by the dashed line 0, the remaining building-side portion by the one lying underneath.

The heating device exhibits four water line ports exiting on the bottom side of the device, specifically a heating flow port 1, a heating return port 2, a cold water port 3 and a hot water port 4. The remaining ports (gas, electric) are not depicted. Therefore, this heating device is used on the one hand to supply heat exchangers 5, for example in the form of radiators, for space heating, as well as heating service water. To this end, the interior of the heating device is provided with a plate heat exchanger 6, with which the cold service water coming from the cold water port 3 is heated and relayed to the hot water port 4. The hot water generated in the heating device in a primary heat exchanger 7, for example through gas combustion, is used for heating purposes, and guided counter currently through the plate heat exchanger 6.

In order to circulate the heat carrier medium, which is typically water, through the primary heat exchanger 7 and secondary heat exchangers 5 and 6, a recirculation pump 8 is provided in the form of a wet-running centrifugal pump. This recirculation pump 8 conveys the heat carrier medium via a pressure line 9 to the primary exchanger 7, where the latter is heated, and either relayed to the plate heat exchanger 6 via a line 10, or to the heating flow port 1 via a line 11, and from there to the heat exchangers 5 of the space heater. The medium exiting the heat exchangers 5 and 6 is relayed via a return line 12, which carries the water coming from the heat exchanger 5, as well as via a return line 13, which carries the water coming from the heat exchanger 6, to a switching valve 14, which depending on the switching position connects either the return line 12 or return line 13 with the inlet side of the pump 8.

The switching valve 14 is controlled via an electric motor in such a way as to connect the return line 12 with the pump 8 during operation. If hot water is to be taken from the service water tap, this is detected by means of a flow sensor 16, and the valve 14 is actuated and switched, so as to connect the return line 13 with the inlet side of the pump 8.

In addition, the heating device exhibits a bypass line 17, which ensures that circulation within the heating device is possible even when both heating circuits are closed. To this end, a pressure relief valve 18 is integrated into the bypass line, and opens starting at a preset differential pressure. In addition, the heating device exhibits other components, of which a differential vessel 19, a safety valve 20 and a fill valve 21 are shown only by way of example.

In order to facilitate the construction of the heating device, in particular the internal construction and piping within the device, both during assembly and subsequent maintenance, a housing unit 22 is provided, designed as a one-piece injection molded plastic.

In the preferred embodiment according to FIGS. 2-8, the housing unit 22 also contains the components labeled 22*a* on FIG. 1, specifically a quadrant pipe 41 for running pipe from the device-side cold water port to the cold water port of the housing unit 22. The housing unit 22 also exhibits the upper rear port 42 for the plate heat exchanger 6, as well as the flow meter 16.

The front portion of this housing unit 22 in its installation position forms a pump housing 23 along with the accompanying connecting flange for a pump head 24, which in a known manner consists of an electric engine, a terminal box with any needed integrated electronics, and an impeller sitting at the free end of the engine shaft. With an annular cover disk 25 integrated, this pump head 24 is secured to the face of the housing unit 22 in such a way that the impeller is arranged in the region of the pump housing 23. The central recess of the cover disk 25 forms the inlet mouth 26 of the pump.

A pressure joint 27 with a corresponding line port adjoins the upper side of the portion of the housing unit 22 that forms the pump housing 23. The inlet mouth 26 empties into an inlet chamber 28 centrally formed inside the housing unit 22, which simultaneously makes up a housing for the switching valve 14. The inlet chamber 28 has an essentially cylindrical shape, and its bottom side in the installation position exhibits an opening 29, which is provided for integrating a connection part 30 used for hooking up a return line 12 leading to the heating return port. This connection part 30, which preferably consists of metal, is tightly integrated into the opening 29 with an O-ring, and positively fixed into position with a U-shaped strap.

The upper end 31 of the connection part 30 here simultaneously forms a valve seat within the inlet chamber 28. For example, this valve seat is shown within the inlet chamber on FIG. 6. The accompanying valve body 32 is formed by an essentially cylindrical, flat body, which sits at the end of a lever 33 that is tightly guided into an opening on the left side of the housing unit and through the wall of the inlet chamber 28, while its other end 34 is actuated by an electromotor drive unit 35 secured to the outside of the housing unit. The lever 33 is pivoted to a bearing 36, and sealed relative to the latter, which is integrated into the graduated, flange-ended opening 37 of the housing unit 22, and fixed in place by the subsequently integrated engine mount 38.

Spaced apart opposite the open end 31, i.e., the valve seat, is the open end of a quadrant pipe 39 molded in the inlet chamber 28, whose end extending freely into the inlet chamber 28 forms a valve seat opposite the valve seat 31, which can alternatively be sealed by the valve body 32. This quadrant pipe 39 is designed as a single piece with the housing unit 22, and empties into the lower, rear side of the port 40 in the installation position, with which housing unit is connected to the lower, right port of the plate heat exchanger 6 in the installation position. Involved in this case is the return line 13 of the plate heat exchanger 6. Since it can be accessed both through the opening free toward the back in the installation position and through the lower opening 29 in the housing unit, as well as from the front on the pump side, this quadrant pipe 30 can be fabricated during fabrication by means of a tool with drawing cores, and without lost cores.

In addition, the housing unit exhibits a quadrant pipe 41 molded onto the outside of the inlet chamber 28, i.e., outside the housing unit 22, which forms the upper port 42 for the heat exchanger, and is designed for connecting the cold water line leading to the cold water port 3. A corresponding line port 43 may be gleaned from FIG. 6, for example. This quadrant pipe 41 can also be designed as a separate component independently of the housing unit. Even given a one-piece configuration with the housing unit, this quadrant pipe 41 can be made out of another type of material tailored to the temperature level and composition of the medium flowing through.

Also integrated into the inlet chamber 28 and intersecting the latter is an air separation housing 44, into which a breather valve 45 can be bayoneted. The air separation housing 44, which to the extent it projects over the actual housing that forms the inlet chamber 28 is cylindrical in design, and molded into the housing unit adjacent to the rear wall of the inlet chamber 28 on the right next to the quadrant pipe 41 as viewed from above (see FIG. 4). A rear port 46 is provided under the air separation housing 44, and empties into the inlet chamber 28. Also provided on the right side in the installation position are two ports 47 and 48 that laterally empty into the inlet chamber 28. For example, these ports 46 to 48 can be used to hook up the differential vessel 19, sensors or other suitable hydraulic connections, which are to be hydraulically linked with the inlet chamber 28.

The rear of the inlet chamber 28 is also adjoined by a channel 49 with a downward, 90° orientation, which is situated on the floor of the inlet chamber 28, and closed by a sealing plug 50. After the sealing plug 50 has been removed, the housing unit can be evacuated almost completely via this channel.

Viewed from above, a channel 51 forming the bypass line 17 and inclined toward the interior of the inlet chamber 28 is provided in roughly the area between the quadrant pipe 41, air separation housing 44 and pressure joint 27. This channel 51, which is open to the outside, empties into the inlet chamber 28, and intersects the line 13 inside the housing unit 22, wherein the free end of this channel 51 is provided with a bayonet, so that a cartridge 52 can be inserted into the free end of the channel 51 and latched there. This cartridge 52 encompasses a pressure relief valve 18, specifically valve 18, and is arranged in the installation position is arranged in such a way as to situate the valve 18 between the line 13 and inlet chamber 28 of the pump. On the one hand, the channel 51 hence forms the end of the return line 13, where it takes the form of a valve seat on the end side, so as to be closed or opened by the valve body 32, while on the other hand, this channel 51 also forms part of the bypass line 17, which as illustrated on FIG. 1, is also comprised of the line 10, heat exchanger 6 and return line 13. However, at roughly the location where it integrates the pressure relief valve 16 like a cartridge, the channel 51 exhibits a recess 53 in the wall to the inlet chamber 28. This recess 53 forms the actual bypass, specifically the connection to the inlet chamber 28 with the pressure relief valve 16 open. In conjunction with the pressure relief valve 16, this connection hence ensures that a line connection to the inlet chamber 28 is established even if the channel 51 is closed on the end side by the valve body 32. Since the pressure relief valve 16 can also be accessed from outside via the free end of the channel 51 in the installation position, this access can also be used to adjust the limiting pressure on the valve 16, provided the valve is adjustable.

Figure 9:
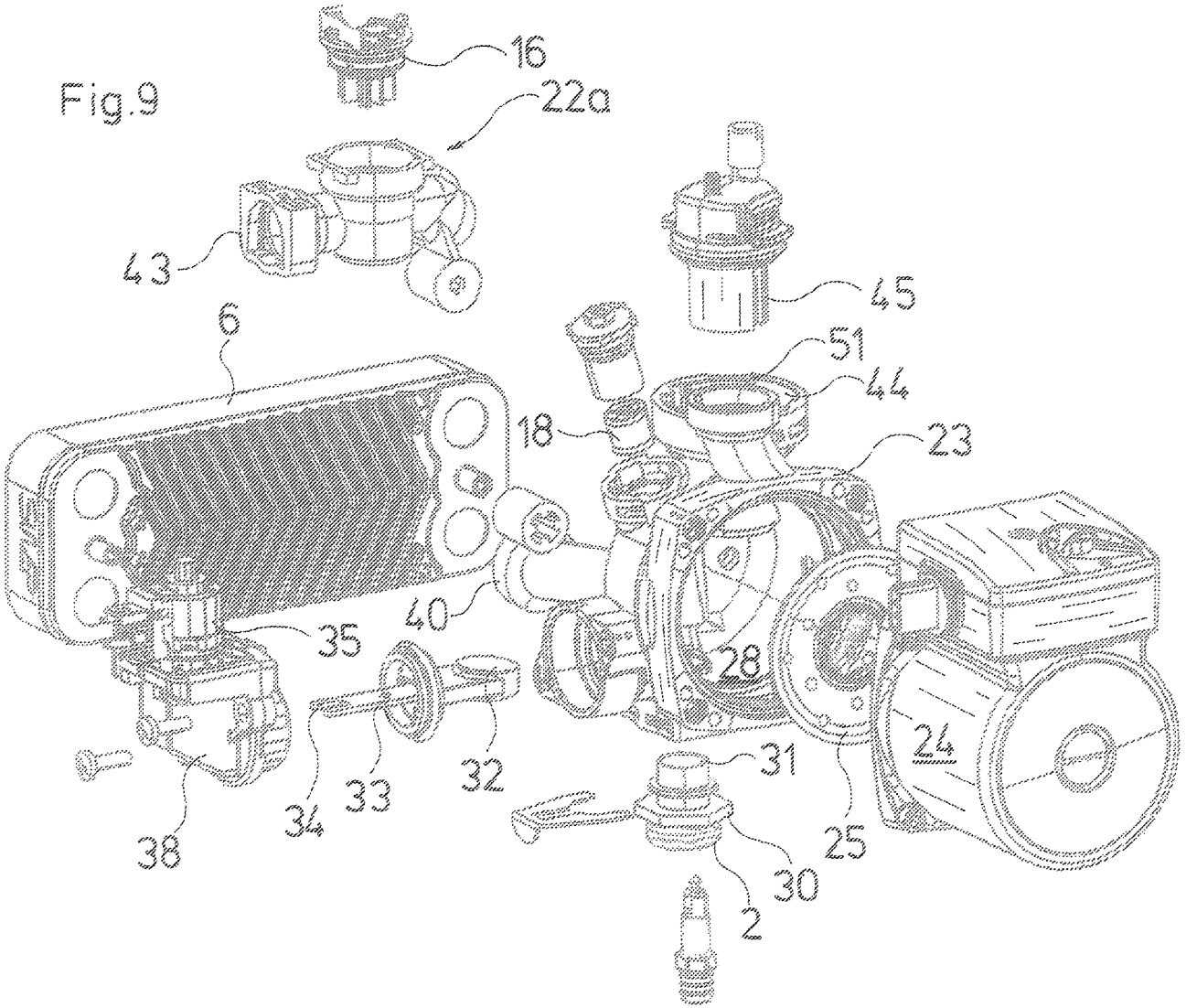
FIG. 9 is a perspective, exploded view according to FIG. 2 of a preferred embodiment of the present invention.

As diagrammatically depicted on FIG. 1, the housing unit 22 does not absolutely have to contain part 22*a* like the embodiment according to FIGS. 2-8. In the preferred embodiment shown on FIG. 9, this part 22*a* of the housing unit 22 is designed as a separate injection molded component, wherein the flow meter 16 is integrated into this component 22*a* via a port opening from above like a cartridge.

The housing unit described above is hooked up to the right port pair of the plate heat exchanger 6. However, it can also be hooked up to the left port pair. Of course, the plate heat exchanger must then also be linked in the reverse sequence.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

The invention claimed is:

1. A heating device with two heating circuits, one for space heating and another for service water heating, a valve (14) for switching between the heating circuits, a recirculation pump, a plate heat exchanger (6) for service water heating, a heat exchanger (5) for space heating and a housing unit (22), said housing unit (22) comprising:

a pump housing (23) for the recirculation pump (8);

an inlet chamber (28) of the pump housing (23) adjoined by an inlet mouth (26) of the recirculation pump (8), the valve (14) being located within the inlet chamber (28);

the inlet chamber (28) having an opening (29) in one side thereof, receiving a first return line (12) from the heat exchanger (5) for space heating, and a pipe (39) projecting into an opposing side of the inlet chamber (28) and receiving a second return line (13) from the plate heat exchanger (6) for service water heating; and a bypass (17) of the valve (14) branching from the second return line (13) to a second opening (53) of the inlet chamber (28), the bypass (17) being closed by a pressure relief valve (18) adjacent the second opening (53), wherein the bypass (17) empties into the inlet chamber (28) via the pressure relief valve (18) when the pressure relief valve (18) is opened.

2. The heating device according to claim 1, wherein the housing unit further comprises two ports (40, 42) arranged one over another in the rear installation position for direct connection to one of two port pairs of the plate heat exchanger (6).

3. The heating device according to claim 1, wherein the channel (39) that leads to the port (40) of the plate heat exchanger (6) leads to a lower port of a port pair of the plate heat exchanger (6).

4. The heating device according to claim 1, wherein the opening (29) for the return line of the heat exchanger for space heating is formed by the line port (2) on a bottom side of the housing unit (22).

5. The heating device according to claim 1, wherein the two channels are formed by pipe sections (39) extending into the inlet chamber (28), which end there in an aligned manner, spaced apart from each other.

6. The heating device according to claim 1, wherein a valve body (32) of the valve (14) is arranged at an end of a lever (33), which in an installation position of the housing unit (22) is horizontally situated, and tightly guided outwardly through a housing wall on a side, while another end (34) of the lever (33) is coupled with a positioning motor (35) that can be secured to the housing unit (22) from outside.

7. The heating device according to claim 1, wherein the housing unit (22) further comprises an air separation housing (44), and the inlet chamber (28) adjoins the air separation housing (44).

8. The heating device according to claim 1, wherein the bypass (17) further includes a bypass channel (51) with an open end outside of the housing unit and which also connects the bypass (17) to the second opening of the inlet chamber (28).

9. The heating device according to claim 8, wherein the pressure-relief valve (18) is inserted as a cartridge (52) into the bypass channel (51) via the open end thereof and detachably secured thereto.

10. The heating device according to claim 1, wherein the housing unit (22) further comprises a port (42) leading to an upper port of the port pair of the plate heat exchanger (6), said port (42) leading to an upper port of the port pair of the plate heat exchanger (6) forming an end of a line channel (39), another end of which is formed as another port (43) on an outside of the housing unit.

11. The heating device according to claim 1, wherein the housing unit is fabricated as a one-piece injection molded plastic without lost cores.

12. The heating device according to claim 1, wherein the one of the channels (12) leading to the line port (2) is closed by a valve body (32) of the valve (14).

13. The heating device according to claim 10, wherein the line channel (39) is bent by about 90° in an installation position of the housing unit (22) toward a left side.

* * * * *